US008055433B2

(12) United States Patent
Omuro et al.

(10) Patent No.: US 8,055,433 B2
(45) Date of Patent: Nov. 8, 2011

(54) FUEL INJECTION CONTROL DEVICE AND METHOD FOR CONTINUOUSLY CONTROLLING FUEL INJECTION DURING ENGINE OPERATION BASED ON THROTTLE POSITION

(75) Inventors: Yoshiya Omuro, Saitama (JP); Kenichi Machida, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 615 days.

(21) Appl. No.: 12/291,329

(22) Filed: Nov. 7, 2008

(65) Prior Publication Data

US 2009/0157279 A1 Jun. 18, 2009

(30) Foreign Application Priority Data

Dec. 17, 2007 (JP) ..... 2007-324709

(51) Int. Cl.
*F02D 41/30* (2006.01)

(52) U.S. Cl. ..... 701/104

(58) Field of Classification Search ..... 701/104, 701/103

See application file for complete search history.

(56) References Cited

U.S. PATENT DOCUMENTS

| | | | | |
|---|---|---|---|---|
| 4,922,877 | A * | 5/1990 | Nagaishi | 701/104 |
| 5,471,963 | A | 12/1995 | Nishioka et al. | |
| 6,082,334 | A * | 7/2000 | Shomura et al. | 701/104 |
| 6,666,191 | B2 * | 12/2003 | Nakagawa et al. | 701/104 |
| 6,681,745 | B2 * | 1/2004 | Hozuki | 701/104 |
| 7,100,576 | B2 * | 9/2006 | Kobayashi et al. | 123/478 |
| 2002/0189590 | A1 * | 12/2002 | Nakagawa et al. | 701/104 |
| 2003/0062028 | A1 * | 4/2003 | Kitagawa et al. | 701/105 |
| 2003/0150428 | A1 * | 8/2003 | Hozuki | 701/104 |
| 2003/0164166 | A1 * | 9/2003 | Takeuchi et al. | 123/674 |
| 2007/0163547 | A1 * | 7/2007 | Nakasaka | 701/104 |

FOREIGN PATENT DOCUMENTS

| | | |
|---|---|---|
| JP | B-62-9740 | 3/1987 |
| JP | 03-033454 A | 2/1991 |
| JP | 03-121229 A | 5/1991 |
| JP | 06-280660 | 10/1994 |
| JP | 2005-042677 | 2/2005 |

* cited by examiner

*Primary Examiner* — Stephen K Cronin
*Assistant Examiner* — Arnold Castro
(74) *Attorney, Agent, or Firm* — Carrier Blackman & Associates, P.C.; Joseph P. Carrier; William D. Blackman

(57) ABSTRACT

A fuel injection control device includes a basic-injection-use map for deriving a basic injection amount and an additional-injection-use map for deriving an additional injection amount, each corresponding to the throttle opening. During operation of the engine, in each engine cycle, a first calculation stage for calculating the basic injection amount, and a second calculation stage provided after the first calculation stage are set. A first injection amount and a second injection amount obtained by applying the throttle opening measured in the first calculation stage and the second calculation stage, respectively, are compared. When the second injection amount is greater than the first injection amount, an additional injection amount is calculated by subtracting the first injection amount from the second injection amount; and when the first injection amount is greater than the second injection amount, the basic injection amount calculated in the first calculation stage is corrected.

20 Claims, 4 Drawing Sheets

FUEL INJECTION CONTROL DEVICE AND METHOD FOR CONTINUOUSLY CONTROLLING FUEL INJECTION DURING ENGINE OPERATION BASED ON THROTTLE POSITION

CROSS-REFERENCE TO RELATED APPLICATIONS

The present application claims priority under 35 USC §119 based on Japanese patent application No. 2007-324709, filed on Dec. 17, 2007. The entire subject matter of this priority document, including specification, claims and drawings, is incorporated by reference herein.

BACKGROUND OF THE INVENTION

1. Field of the Invention

The present invention relates to a fuel injection control device and method for continuously controlling an amount of fuel injected into an engine during operation thereof. More particularly, the present invention relates to a fuel injection control device which is configured to continuously correct a currently applicable fuel injection amount in response to a change in throttle opening during engine operation.

2. Description of the Background Art

There are several known fuel injection control devices which detect a change of throttle opening, and which are operable to correct a fuel injection amount based on a changed amount of the throttle opening. An example of such fuel control device is disclosed in Japanese published Patent Document JP-B-62-9740.

The Japanese published Patent Document JP-B-62-9740 discloses a fuel injection control device which, when an increasing rate of a throttle opening within a predetermined time exceeds a predetermined value, incrementally increases an injection fuel amount independent from a basic fuel injection amount.

However, according to Japanese Patent Document JP-B-62-9740, the additional fuel injection is performed only once at an initial stage of acceleration. Hence, even when a further change of throttle opening is continued, during the operation of the engine, the fuel injection control device of this reference is not configured to execute an updated fuel injection amount correction corresponding to such a change.

The present invention has been made to overcome such drawbacks of the existing fuel injection control device. Accordingly, it is one of the objects of the present invention to provide a fuel injection control device which overcomes the above-mentioned drawbacks of the related art, and which continuously corrects a fuel injection amount in response to a change of throttle opening.

SUMMARY OF THE INVENTION

In order to achieve the above-mentioned objects, the present invention according to a first aspect thereof provides a fuel injection control device which continuously corrects an injection amount based on throttle opening. The fuel injection control device includes a basic-injection-use map for deriving a basic fuel injection amount corresponding to a throttle opening, and an additional-injection-use map for deriving an additional injection amount corresponding to a throttle opening.

During the operation of the engine, one engine cycle which is divided into a predetermined number of stages includes a first calculation stage for calculating the basic injection amount, and a second calculation stage which succeeds the first calculation stage. A first additional injection amount is obtained by applying a throttle opening measured in the first calculation stage to the additional-injection-use map. A second additional injection amount obtained by applying a throttle opening measured in the second calculation stage to the additional-injection-use map. The first additional injection amount and the second additional injection amount are then compared with each other.

When the second injection amount is greater than the first injection amount, an additional injection with an amount independent from the basic injection amount is performed by using a calculated additional injection amount obtained by subtracting the first injection amount from the second injection amount; and when the first injection amount is greater than the second injection amount, the basic injection amount calculated in the first calculation stage is corrected.

A second aspect of the present invention is characterized in that the second calculation stage is set in a period from a point of time that the first calculation stage elapses to a point of time that an intake valve is closed in an immediate intake stroke.

A third aspect of the present invention is characterized in that the predetermined number of stage is set by division based on crank pulse signals including a non-toothed portion of a pulse rotor, and the non-toothed portion is arranged at a remotest position from an overlapping top position of an intake valve and an exhaust valve, and the second calculation stage is set at a position where the second calculation stage does not overlap with the non-toothed portion.

A fourth aspect of the present invention is characterized in that the first calculation stage is set at a predetermined fixed stage, and the second calculation stage is set at a stage which is changeable corresponding to an engine rotary speed.

A fifth aspect of the present invention is characterized in that a plurality of additional-injection-use maps is set corresponding to the changeable, variable set stage of the second calculation stage.

ADVANTAGES OF THE INVENTION

According to the first aspect of the present invention, the fuel injection control device includes the basic-injection-use map for deriving the basic injection amount corresponding to the throttle opening, and the additional-injection-use map for deriving the additional injection amount corresponding to the throttle opening, one engine cycle during operation of the engine is divided into the predetermined number of stages which includes the first calculation stage for calculating the basic injection amount and the second calculation stage which succeeds the first calculation stage therein. The first injection amount obtained by applying the throttle opening measured in the first calculation stage to the additional-injection-use map, and the second injection amount obtained by applying the throttle opening measured in the second calculation stage to the additional-injection-use map are compared with each other.

According to the first aspect of the present invention, when the second injection amount is greater than the first injection amount, the additional injection with the amount independent from the basic injection amount is performed using the value obtained by subtracting the first injection amount from the second injection amount, and when the first injection amount is greater than the second injection amount, the basic injection amount calculated in the first calculation stage is corrected.

Due to such constitution of the first aspect of the present invention, it is possible to execute the injection amount correction in response to the change of throttle opening for each one engine cycle. Accordingly, even when the change of the throttle opening is sharp or even when the change of the throttle opening is continued over a plurality of cycles, it is possible to optimize the correction amount by executing the injection amount correction for each one cycle.

Further, it is possible to perform not only the amount increasing correction to perform the additional injection in response to the change of throttle opening in the opening direction but also the amount decreasing correction in response to the change of throttle opening in the closing direction. Hence, an operational responsiveness of an engine output to the throttle operation can be increased.

According to the second aspect of the present invention, the second calculation stage is set in a period from a point of time that the first calculation stage elapses to a point of time that an intake valve is closed in an immediate intake stroke. Due to such configuration, the correction amount can be calculated from the point of time that the first calculation stage elapses to a point of time that the immediate intake stroke is finished, and the injection can be performed based on the corrected injection amount in the immediate intake stroke.

According to the third aspect of the present invention, the predetermined number of stage is set by division based on crank pulse signals including a non-toothed portion, and the non-toothed portion of the crank pulser is arranged at a position remotest from an overlapping top position of an intake valve and an exhaust valve, and the second calculation stage is set at a position where the second calculation stage does not overlap with the non-toothed portion.

Due to such configuration of the third aspect, i.e., arranging the second calculation stage before the intake stroke, it is possible to set the second calculation stage outside the non-toothed portion but within a range where the actual crank pulse is detected so that the stage separation becomes distinct.

According to the fourth aspect of the present invention, the first calculation stage is set at the predetermined fixed stage, and the second calculation stage is set at a stage which is changeable corresponding to an engine rotary speed. Due to such configuration, it is possible to always set the second calculation stage at the optimum position corresponding to the engine rotary speed.

According to the fifth aspect of the present invention, the plurality of additional-injection-use maps is set corresponding to the set stage of the second calculation stage. Accordingly, by selecting an additional-injection-use map form a group of the additional-injection-use maps corresponding to the engine rotary speed, it is possible to derive the optimum correction amount.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

An illustrative embodiment of the invention is explained in detail hereinafter in conjunction with drawings.

Figure 1:
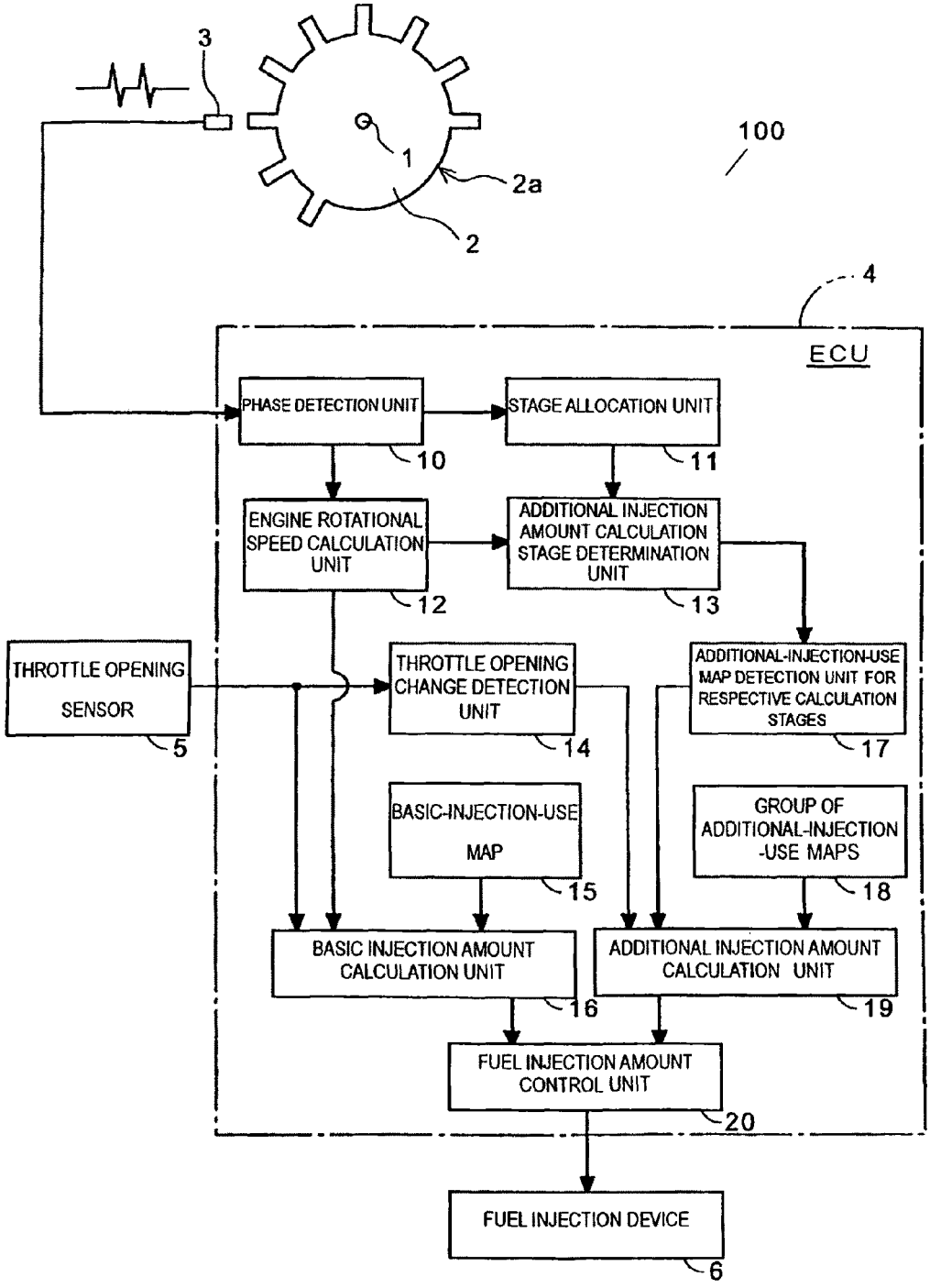
FIG. 1 is a block diagram showing configuration of a fuel injection control device according to an illustrative embodiment of the present invention.

FIG. 1 is a block diagram showing a configuration of a fuel injection control device 100 according to an illustrative embodiment of the present invention. A crankshaft 1 of an engine is provided with a crank pulser rotor 2 and a pulse generator 3. This matched pair of components 2, 3 outputs nine (9) crank pulses for each one rotation of the crankshaft 1. The crank pulse rotor 2 includes nine projecting portions arranged at intervals of 30 degrees, and also includes a non-toothed portion 2*a* extending for an angle of approximately 120 degrees. An output signal transmitted from the pulse generator 3 is inputted to a phase detection unit 10 of an ECU 4.

The phase detection unit 10 detects a phase of the crankshaft 1 based on crank pulses. A stage count allocation unit 11 divides one rotation of the crankshaft into nine segments in response to output timings of crank pulses, and allocates stage counts of "0" to "9" (360-degree stage) to respective phases of the crankshaft, and allocates, upon completion of the determination of the stroke of the engine, absolute stages of "0" to "17" (720-degree stage) to respective phases of 1 cycle (720 degree) of the crankshaft.

Further, an engine rotary speed calculation unit 12 detects an engine rotary speed in response to an output signal from the phase detection unit 10. The fuel injection device 6, which includes a fuel injection valve and the like, is driven in response to a control signal from a fuel injection amount control unit 20 arranged in the ECU 4. The fuel injection amount control unit 20 determines a control signal transmitted to the fuel injection device 6 in response to an output signal received from a basic injection amount calculation unit 16 and an additional injection amount calculation unit 19.

The basic injection amount calculation unit 16 calculates a basic injection amount at the time of performing the basic injection based on throttle opening detected by a throttle position sensor 5 and an engine rotary speed detected by the engine rotary speed calculation unit 12 by applying a basic-injection-use map 15.

On the other hand, an additional injection amount calculation unit 19 calculates a correction amount when a predetermined change occurs with respect to the throttle opening, for example, when a throttle is suddenly opened at the time of performing sudden acceleration or the like. The correction amount includes, an additional injection amount which is performed independently from the basic injection, when the throttle is changed in the opening direction; and a reduction amount which is an amount reduced from the basic injection amount, when the throttle is changed in the closing direction.

The additional injection amount calculation unit 19 calculates a correction amount based on a throttle opening information received from a throttle opening change detection unit 14, an additional-injection-use map determination unit 17 for respective calculation stages and a group of an additional-injection-use maps 18. The throttle opening change detection unit 14 detects a change amount of throttle opening within a predetermined time based on information received from the throttle position sensor 5.

Further, an additional injection amount calculation stage determination unit 13 determines a position of the additional injection amount calculation stage for calculating the additional injection amount based on information from the engine rotary speed calculation unit 12 and the stage allocation unit 11. The detail of the additional injection amount calculation stage is described later.

The additional-injection-use map determination unit 17 for respective calculation stages selects one additional-injection-use map from the group of additional-injection-use maps 18 based on information received from the additional injection amount calculation stage determination unit 13.

Figure 2:
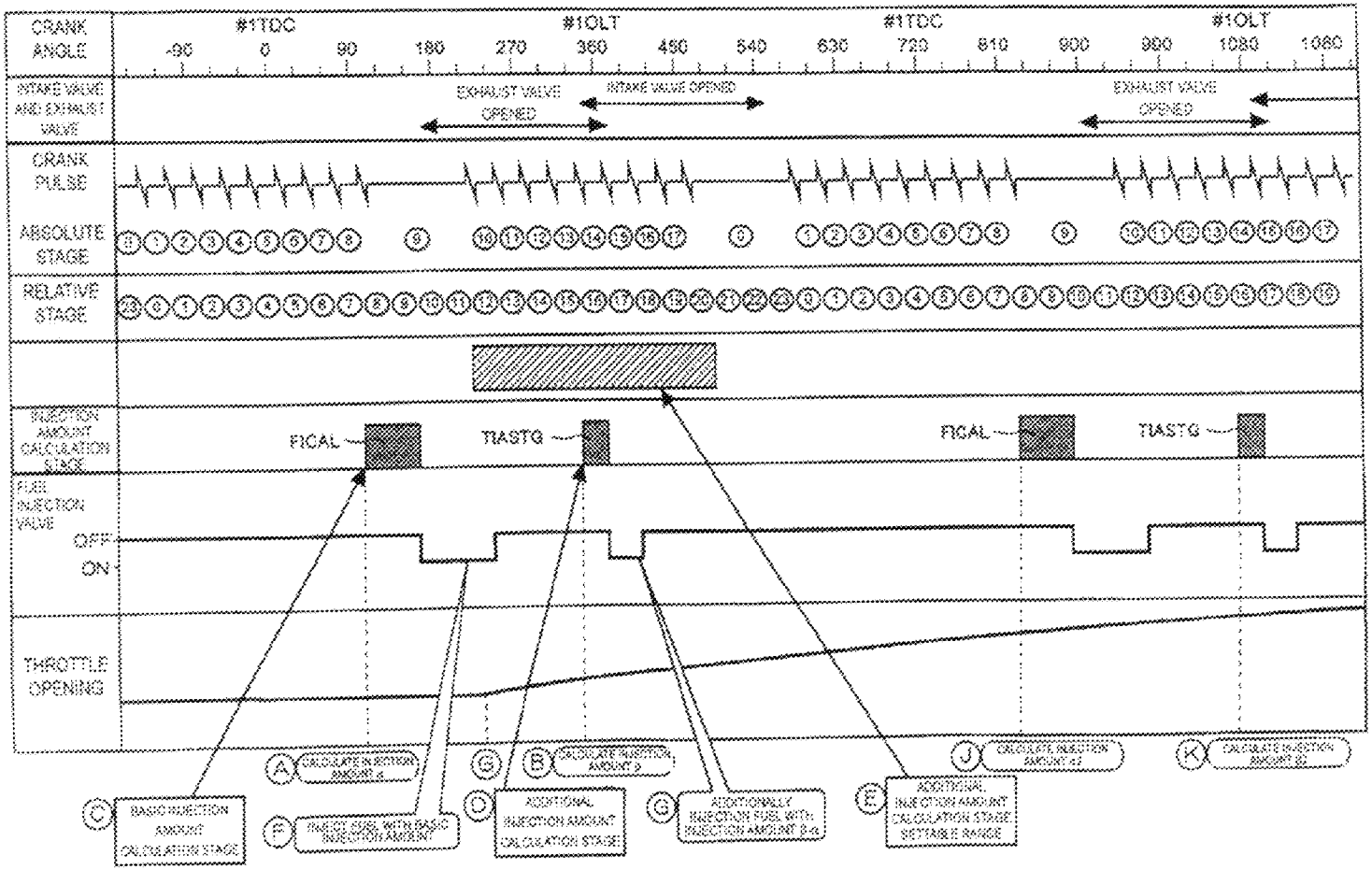
FIG. 2 is a time chart showing a flow of operation of the fuel injection control device.
Figure 3:
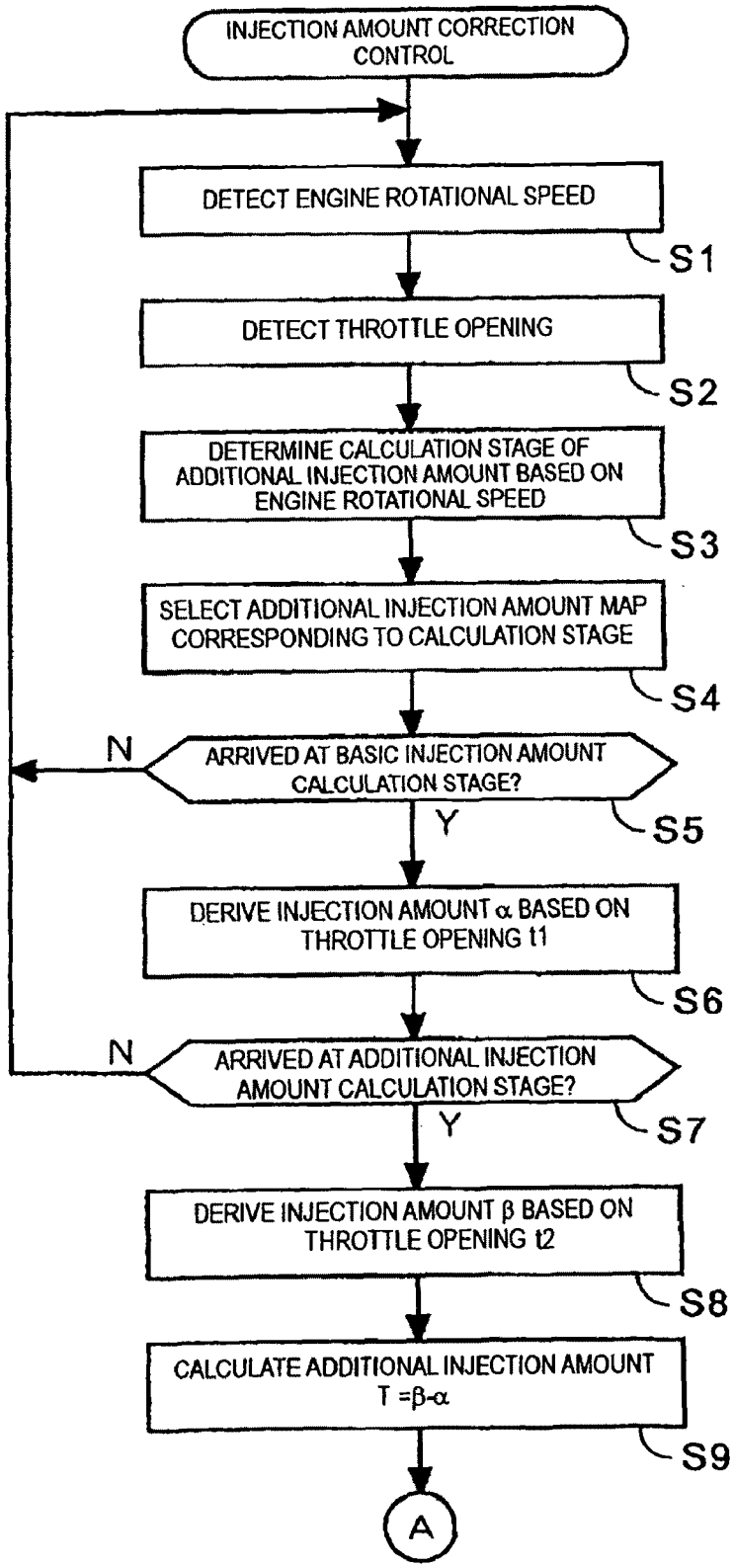
FIG. 3 is a flow chart (1 of 2) showing continuation of the flow of fuel injection amount correction control.
Figure 4:
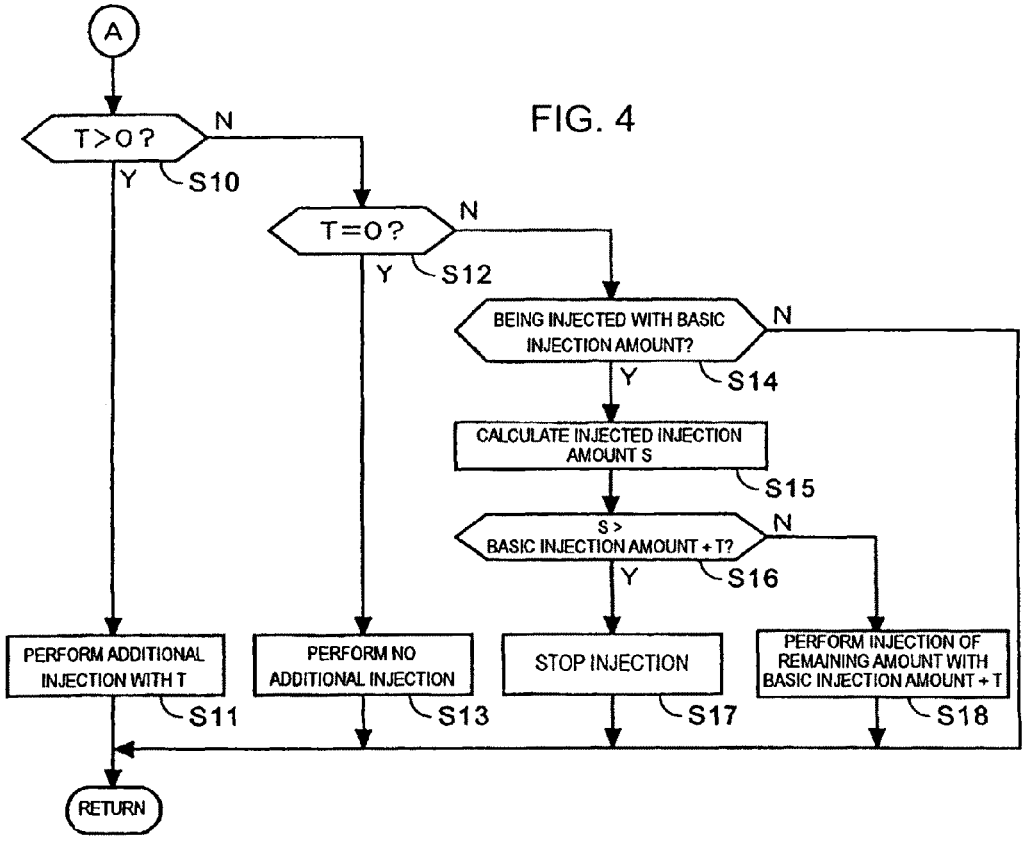
FIG. 4 is a flow chart (2 of 2) showing continuation of the flow of the fuel injection amount correction control of FIG. 3.

FIG. 2 is a time chart showing the flow of an operation of the fuel injection control device according to the illustrative embodiment of the present invention. Further, FIG. 3 and FIG. 4 are flow charts showing the flow of a fuel injection amount correction control according to the illustrative embodiment of the present invention.

In the time chart shown in FIG. 2, a "crank angle" in an uppermost row indicates a rotational angle of the crank from a predetermined angle. The predetermined angles of the crank angle indicate a position of compression top dead center (TDC) and a position of a valve overlapping top (OLT) of a predetermined cylinder. A second row, directly below the uppermost row, indicates open/close timing of an intake valve and an exhaust valve of the predetermined cylinder. A third row indicates crank pulses generated by the pulse generator 3.

Further, rows below these rows indicate absolute stages (720-degree stage after the stroke determination is established) corresponding to the crank pulses and relative stages "0" to "23" which divide the non-toothed portion into four and indicate 1 cycle which includes stages all arranged at equal intervals.

The row of entitled, "injection amount calculation stage" indicates execution timing of a basic injection amount calculation stage which constitutes a first calculation stage and execution timing of an additional injection amount calculation stage which constitutes a second calculation stage. The timings of both calculation stages correspond to the predetermined positions of the relative stage.

Further, a row entitled, "ON/OFF of fuel injection valve" indicates operational timing of the fuel injection device 6 which is set such that the fuel injection device 6 continues the injection under a fixed pressure during electricity is supplied and stops the injection when electricity is not supplied. The lowermost row entitles, "throttle opening" in indicates an output signal of the throttle sensor 5 mounted on a throttle operated by a rider of a vehicle. The output signal is set such that the output is increased along with the increase of the throttle opening.

Here, it is necessary to execute the fuel injection by the fuel injection device before the intake valve is closed so that the fuel is sucked in a combustion chamber within the same cycle. In the illustrative embodiment, as shown in FIG. 2, a basic injection amount calculation stage (C) in which the basic injection amount is calculated using the basic-injection-use map 15 is set to be executed in 8th to 9th stages of the relative stage (hereinafter, referred to as relative stages unless otherwise specified), and the basic injection amount calculation stage is set such that the injection (F) with the basic injection amount is started from the succeeding 10th stage.

Here, the injection amount may be set based on a period during which electricity is continuously supplied to the fuel injection valve.

On the other hand, there may be a situation in which a required amount of fuel is sharply increased due to the sudden acceleration or the like so that the amount increasing correction of the injection amount is desirable to cope with the sharp increase of the required amount of fuel. In such situation, there is known a technique which performs the additional injection independently from the basic injection amount.

The fuel injection control device according to the present invention is characterized in that such an additional injection amount can be adjusted corresponding to a change amount of throttle opening. Further, the amount increasing correction by the additional injection can be executed not only once at an initial stage of the acceleration but also during a period in which the throttle opening is changed continuously.

Further, when the throttle opening is changed in the closing direction, the additional injection may not be performed and the already-calculated basic injection amount may be corrected. Such correction of the injection amount may be realized by providing an additional injection amount calculation stage (D) for calculating the additional injection amount after the basic injection amount calculation stage (C) which sets the basic injection amount.

Hereinafter, in conjunction with FIG. 2 and flow charts shown in FIGS. 3 and 4, the manner of operation of the injection amount correction control according to the present invention is explained. Here, in the following explanation, the basic injection amount calculation stage (C) may be also referred to as "FICAL", and the additional injection amount calculation stage (D) may be also referred to as "TIASTG".

FIGS. 3 and 4 are flow charts showing the flow of the injection amount correction control according to the present invention. In step S1, the engine rotary speed is detected by the engine rotary speed calculation unit 12, and in step S2, the throttle opening is detected by the throttle position sensor 5. In step S3, the stage number of the additional injection amount calculation stage (D) corresponding to the engine rotary speed is determined by the additional injection amount calculation stage determination unit 13 (see FIG. 1).

The additional injection amount calculation stage (D) is selected among 12th to 20th stages within a setting allowable range (E) corresponding to the engine rotary speed. For example, additional injection amount calculation stage (D) may be set such that the higher the engine rotary speed, the smaller relative stage number is selected. In the illustrative embodiment, the additional injection amount calculation stage (D) in the first cycle is set to the relative stage "16".

Here, a position of the non-toothed portion 2*a* of the crank pulser rotor 2 with respect to a phase of the crank is set remotest from a valve overlapping top (OLT) of the predetermined cylinder so that the non-toothed portion 2*a* does not overlap with the valve overlapping top (OLT).

Further, the above-mentioned additional injection amount calculation stage setting allowable range (E) is a set at a position where the additional injection amount calculation stage setting allowable range (E) does not overlap with the non-toothed portion. In the illustrative embodiment, while FICAL (C) is set to start from a starting point of the non-toothed portion 2*a* of the crank pulse, TIASTG (D) is set at a position which avoids the non-toothed portion 2*a*.

Figure 5:
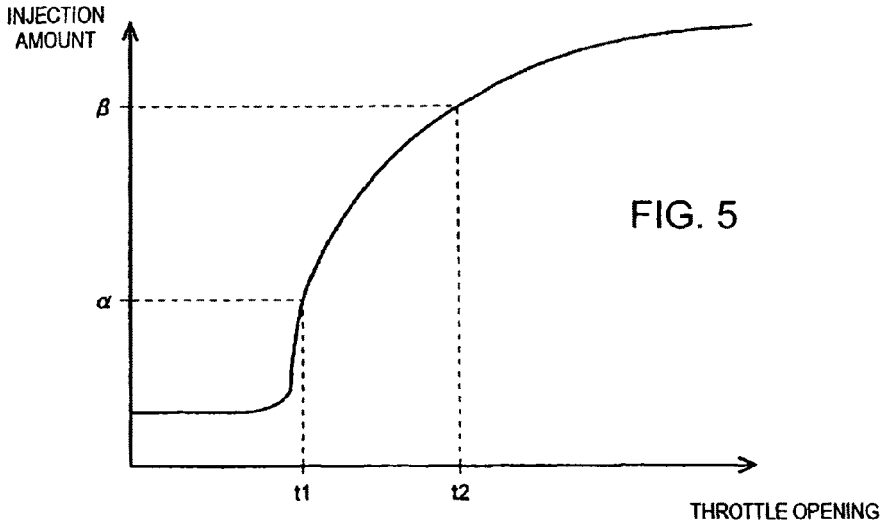
FIG. 5 is an example of an additional-injection-use map.

In step S4, the additional-injection-use map corresponding to the stage number determined in step S3 is selected from the group of additional-injection-use maps 18. The group of additional-injection-use maps 18 of this embodiment may be constituted of 9 kinds of additional-injection-use maps which respectively correspond to the 12th to 20th stages of the relative stage, for example. An example of an additional-injection-use map is shown in FIG. 5, which provides a relationship graph (a data table) of an injection amount corresponding to a throttle opening.

In step S5, it is determined whether or not the phase of the crank arrives at the basic injection amount calculation stage (C). When the determination is affirmative, the processing advances to step S6. In the illustrative embodiment, when the phase of the crank arrives at the 8th or 9th stage, the processing advances to step S6. The basic injection amount calculation stage (C) is a stage for calculating a basic injection amount using the basic-injection-use map 15 based on information such as engine rotary speed, throttle opening or a vehicle speed.

However, the fuel injection control device of the present invention is configured such that the injection amount used for correction is also calculated in the basic injection amount calculation stage (C). This processing is executed in step S6. In step S6, by applying a throttle opening t1 measured in the basic injection amount calculation stage (C) to the additional-injection-use map (see FIG. 5) selected in step S4, an injection amount $\alpha$ is calculated as a first injection amount (A).

In succeeding step S7, it is determined whether or not the phase of the crank arrives at the additional injection amount calculation stage (D). When the determination is affirmative, the processing advances to step S8. In the illustrative embodiment, when the phase of the crank arrives at the 16th stage, the processing advances to step S8. The additional injection amount calculation stage (D) is provided for enabling the correction of an injection amount in an immediate intake stroke even when the throttle opening is changed after the basic injection amount is already calculated in the basic injection amount calculation stage (C).

As described above, the additional injection amount calculation stage (D) is set within the range from 12th to 20th stages of the relative stages. The 12th to 20th stages correspond to a period from a point of time that the basic injection amount calculation stage (C) elapses to the limit stage number which allows the execution of the fuel injection while the intake valve is opened. Here, when the determination is negative in step S5 or S7, the processing returns to step S1.

In step S8, by applying throttle opening t2 measured in the additional injection amount calculation stage (D) to the additional-injection-use map selected in step S4, an injection amount $\beta$ is derived as a second injection amount (B).

In order to explain the operation of the fuel control device with reference to the time chart shown in FIG. 2, the throttle starts opening (G) immediately before finishing of the injection (F) with the basic injection amount which is started simultaneously with the finishing of FICAL, that is, in the vicinity of the 12th stage of the relative stage and, thereafter, the throttle is continuously changed in the opening direction.

The injection amount $\beta$ derived in step S8 is a value which reflects an increase of the throttle opening. In step S9, by subtracting the injection amount $\alpha$ from the above-mentioned injection amount $\beta$, an additional injection amount T is calculated by using the equation, $T=\beta-\alpha$.

In succeeding step S10, it is determined whether or not the additional injection amount T satisfies $T>0$. In the example shown in FIG. 2, the throttle is driven in the opening direction due to acceleration and the relationship of $\beta>\alpha$ is established. Hence, the additional injection amount T assumes a positive value. Accordingly, the determination is affirmative in step S10, and the processing advances to step S11.

In step S11, upon finishing of the additional injection amount calculation stage (D), the additional injection is executed by applying the additional injection amount T (G), and a series of controls are finished. Due to such additional injection (G), a proper amount of fuel corresponding to an increase rate of the throttle opening is supplied. Accordingly, it is possible to enhance responsiveness of an engine output at the time of acceleration.

Here, the additional injection may be executed only when the calculated additional injection amount T is the predetermined value or more or when the detected value by the throttle opening change detection unit 14 (see FIG. 1) is the predetermined value or more.

On the other hand, when the determination is negative in step S10, the processing advances to step S12, and it is determined whether or not the additional injection amount T is 0. When the determination is affirmative in step S12, that is, when the additional injection amount is 0, this implied that the throttle opening is not changed during the period from FICAL to TIASTG.

Accordingly, it is determined that the additional injection is unnecessary. Hence, the processing advances to step 13, and thus, finishing a series of controls without executing the additional injection. Here, when the throttle opening change detection unit 14 (see FIG. 1) detects that the change amount of the throttle opening is 0 or the change amount is less than the predetermined value, the injection amount correction control may be immediately finished.

Further, when the determination is negative in step S12, the additional injection amount T assumes a negative value. This indicates that the throttle opening is changed in the closing direction during the period from the FICAL to the TIASTG. When the throttle is changed in the closing direction, there is a possibility that the basic injection amount which is already calculated in the FICAL becomes excessive with respect to an injection amount required by the engine.

Accordingly, in the injection amount correction control according to the illustrative embodiment, by executing the processing after step S14, the proper injection amount correction can be executed even when the throttle opening is changed in the closing direction.

In step S14, it is determined whether or not the injection is being performed based on the basic injection amount. This determination is made because, depending on a state of the throttle opening or the engine rotary speed, there is a possibility that the injection based on the basic injection amount is continued at a point of time that TIASTG is finished. When the determination is affirmative in step S14, the processing advances to step S15, and an injection amount S which is already injected out of the basic injection amount is calculated.

Subsequently, in step S16, it is determined whether or not a value obtained by adding the additional injection amount T to the basic injection amount is less than the injected injection amount S. Here, the additional injection amount T is a negative value. Hence, the determination in step S16 may be expressed as the determination "whether or not a correction amount obtained by subtracting an absolute value of the additional injection amount T from the basic injection amount is less than the injected injection amount S.

When the determination is affirmative in the step S16, it is determined that the necessary amount is already injected. Accordingly, the processing advances to step S17 and the injection is stopped.

On the other hand, when the determination is negative in step S16, the processing advances to step S18 and the remaining amount of fuel is injected based on the corrected amount (basic injection amount+T), which is obtained by subtracting the absolute value of the additional injection amount T from the basic injection amount, and a series of controls are finished.

The injection amount correction described above can be executed for each and every cycle. As shown in FIG. 2, even when the change of the throttle opening is continued over the next cycle, an injection amount $\alpha 2$ is derived in the next FICAL (stage J), and an injection amount $\beta 2$ is derived in TIASTG which is set thereafter (stage K) are calculated. In order to calculate a new additional injection amount supplied in the next intake stroke, the injection amount $\alpha 2$ is subtracted from the injection amount $\beta 2$.

As described above, according to the fuel injection control device of the present invention, after the FICAL (first calculation stage) for calculating the basic injection amount and before the immediate intake stroke, the TIASTG (second calculation stage) for calculating the additional injection amount is provided, and the correction amount is calculated based on the throttle opening measured in each stage so as to correct the fuel injection amount of the immediate intake stroke.

Accordingly, it is possible to execute the injection amount correction corresponding to the change of the throttle opening for each cycle. Therefore, even when the change of the throttle opening is continued over a plurality of cycles, the injection amount correction can be executed for each cycle so as to optimize the correction amount. Hence, it is possible to further enhance the responsiveness of the engine output in response to the throttle operation.

Further, a shape of the crank pulser rotor, the number of the crank pulses, the number of the absolute stages and stage numbers allocated to the relative stages, the setting positions and lengths of the FICAL and the TIASTG, the modes of the additional-injection-use maps, items of the flow charts of the fuel injection control shown in FIGS. 3 and 4 and the like are not limited to the above-mentioned embodiment, and various modification are conceivable.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A fuel injection control device for continuously correcting an injection amount for an engine based on a sensed throttle opening, said fuel injection control device comprising:

an electronic control unit operatively connected to a plurality of sensors in an internal combustion engine, said plurality of sensors including a throttle position sensor;

a basic-injection-use map stored in a recordable data storage medium for deriving a basic injection amount corresponding to a sensed throttle opening; and an additional-injection-use map stored in a recordable data storage medium for deriving an additional injection amount corresponding to said sensed throttle opening;

wherein said fuel injection control device is configured to divide each engine cycle into a predetermined number of stages; said predetermined number of stages comprising a first calculation stage for calculating the basic injection amount; and a second calculation stage provided after the first calculation stage;

wherein said first and second calculation stages are set in each engine cycle;

wherein said fuel injection control device is operated such that:

a first injection amount is obtained by applying a throttle opening measured in the first calculation stage to the additional-injection-use map;

a second injection amount is obtained by applying a throttle opening measured in the second calculation stage to the additional-injection-use map;

said first injection amount and said second injection amount are compared with each other; and wherein when the second injection amount is greater than the first injection amount, an additional fuel injection with an amount independent from the basic injection amount is performed based on a calculated injection amount obtained by subtracting the first injection amount from the second injection amount; and when the first injection amount is greater than the second injection amount, the basic injection amount from the first calculation stage is corrected.

2. A fuel injection control device according to claim 1, wherein the first calculation stage is fixedly set at one of said predetermined number of stages, and the second calculation stage is set as a changeable stage corresponding to an engine rotary speed.

3. A fuel injection control device according to claim 2, further comprising a plurality of additional-injection-use maps, each of said plurality of additional-injection-use maps corresponding to the changeable stage of the second calculation stage.

4. A fuel injection control device according to claim 1, further comprising a crank pulse rotor associated with a crankshaft of the engine, said crank pulse rotor having a non-toothed portion;

wherein the predetermined number of stages is set by a division based on crank pulse signals including the non-toothed portion arranged at a position remotest from an overlapping top position of an intake valve and an exhaust valve of the engine; and wherein the second calculation stage is set at a position where the second calculation stage does not overlap with the non-toothed portion.

5. A fuel injection control device according to claim 4, wherein the first calculation stage is fixedly set at one of said predetermined number of stages, and the second calculation stage is set as a changeable stage corresponding to an engine rotary speed.

6. A fuel injection control device according to claim 5, further comprising a plurality of additional-injection-use maps, each of said plurality of additional-injection-use maps corresponding to the changeable stage of the second calculation stage.

7. A fuel injection control device according to claim 1, wherein said second calculation stage is set in a period from a point of time that the first calculation stage elapses to a point of time that an intake valve of the engine is closed in an immediate intake stroke.

8. A fuel injection control device according to claim 7, further comprising a crank pulse rotor associated with a crankshaft of the engine, said crank pulse rotor having a non-toothed portion;

wherein the predetermined number of stages is set by a division based on crank pulse signals including the non-toothed portion arranged at a position remotest from an overlapping top position of an intake valve and an exhaust valve of the engine; and wherein the second calculation stage is set at a position where the second calculation stage does not overlap with the non-toothed portion.

9. A fuel injection control device according to claim 7, wherein the first calculation stage is fixedly set at one of said predetermined number of stages, and the second calculation stage is set as a changeable stage corresponding to an engine rotary speed.

10. A fuel injection control device according to claim 9, further comprising a plurality of additional-injection-use maps, each of said plurality of additional-injection-use maps corresponding to the changeable stage of the second calculation stage.

11. A fuel injection control device for an internal combustion engine for continuously executing correction of a fuel injection amount based on a throttle opening of the engine, said fuel injection control device comprising:

an electronic control unit operatively connected to a plurality of sensors in an internal combustion engine, said plurality of sensors including a throttle position sensor for detecting a throttle opening;

a throttle opening change detection unit for detecting a change in a throttle opening;

a basic-injection-use-map stored in a recordable data storage medium for deriving a basic injection amount corresponding to a sensed throttle opening;

an additional-injection-use map stored in a recordable data storage medium for deriving an additional injection amount corresponding to a change in a sensed throttle opening;

wherein said fuel injection control device is configured to divide each engine cycle into a predetermined number of stages; said predetermined number of stages comprising a first calculation stage, and a second calculation stage provided after the first calculation stage;

wherein said fuel injection is operated such that:

said basic injection amount is obtained by applying a throttle opening measured in the first calculation stage to the basic-injection-use map;

a first injection amount is obtained by applying a change in a throttle opening measured in the first calculation stage to the additional-injection-use map; and a second injection amount obtained by applying a change in a throttle opening measured in the second calculation stage to the additional-injection-use map;

wherein said first injection amount and said second injection amount are compared with each other;

when the second additional injection amount is greater than the first additional injection amount, an additional fuel injection with an amount independent from the basic injection amount is performed based on a calculated injection amount obtained by subtracting the first injection amount from the second injection amount; and when the first additional injection amount is greater than the second additional injection amount, the basic injection amount calculated in the first calculation stage is corrected.

12. A fuel injection control device according to claim 11, wherein said second calculation stage is set in a period from a point of time that the first calculation stage elapses to a point of time that an intake valve of the engine is closed in an immediate intake stroke.

13. A fuel injection control device according to claim 11, further comprising a crank pulse rotor associated with a crankshaft of the engine, said crank pulse rotor having a non-toothed portion;

wherein the predetermined number of stages is set by a division based on crank pulse signals including the non-toothed portion arranged at a position remotest from an overlapping top position of an intake valve and an exhaust valve of the engine; and wherein the second calculation stage is set at a position where the second calculation stage does not overlap with the non-toothed portion.

14. A fuel injection control device according to claim 11, wherein the first calculation stage is fixedly set at one of said predetermined number of stages, and the second calculation stage is set as a changeable stage corresponding to an engine rotary speed.

15. A fuel injection control device according to claim 11, further comprising a plurality of additional-injection-use maps, each of said plurality of additional-injection-use maps corresponding to said changeable stage of the second calculation stage.

16. A method of continuously controlling a fuel injection amount based on a throttle opening of an internal combustion engine, wherein each engine cycle during operation of the engine is divided into a predetermined number of stages comprising a first calculation stage, and a second calculation stage provided after said first calculation stage;

said method comprising the steps of a) monitoring a throttle opening using a throttle position sensor;

b) deriving a basic injection amount corresponding to a sensed throttle opening at said first calculation stage using a basic-injection-use map;

c) deriving a first additional injection amount corresponding to a change in a throttle opening at said first calculation stage using an additional-injection-use map;

d) deriving a second additional injection amount corresponding to a change in a throttle opening at said second calculation stage using said additional-injection-use map;

e) comparing said first additional injection amount and said second additional injection amount;

f) when the second additional injection amount is greater than the first additional injection amount, applying an additional calculated injection amount obtained by subtracting the first additional injection amount from the second additional injection amount;

when the first additional injection amount is greater than the second additional injection amount, correcting the basic injection amount; and g) repeating steps a-f as needed.

17. A method of continuously controlling a fuel injection amount according to claim 16, wherein said second calculation stage is set in a period from a point of time that the first calculation stage elapses to a point of time that an intake valve of the engine is closed in an immediate intake stroke.

18. A method of continuously controlling a fuel injection amount according to claim 16, wherein the predetermined number of stages is set by a division based on crank pulse signals from a crank pulse rotor including signal from a non-toothed portion thereof; wherein said non-toothed portion of the crank pulse rotor is arranged at a position remotest from an overlapping top position of an intake valve and an exhaust valve; and wherein the second calculation stage is set at a position where the second calculation stage does not overlap with the non-toothed portion.

19. A method of continuously controlling a fuel injection amount according to claim 16, wherein the first calculation stage is fixedly set at one of said predetermined number of stages, and the second calculation stage is set as a changeable stage corresponding to an engine rotary speed.

20. A method of continuously controlling a fuel injection amount according to claim 16, further comprising a plurality of additional-injection-use maps, each of said plurality of additional-injection-use maps corresponding to the set stage of the second calculation stage.

* * * * *